US006521058B1

(12) United States Patent
Inoue et al.

(10) Patent No.: US 6,521,058 B1
(45) Date of Patent: Feb. 18, 2003

(54) HIGH-STRENGTH HIGH-TOUGHNESS AMORPHOUS ZIRCONIUM ALLOY

(75) Inventors: Akihisa Inoue, Sendai (JP); Tao Zhang, Sendai (JP)

(73) Assignee: Japan Science and Technology Corporation, Kawaguchi (JP)

( * ) Notice: Subject to any disclaimer, the term of this patent is extended or adjusted under 35 U.S.C. 154(b) by 0 days.

(21) Appl. No.: 09/582,611

(22) PCT Filed: Oct. 25, 1999

(86) PCT No.: PCT/JP99/05872

§ 371 (c)(1),
(2), (4) Date: Jun. 29, 2000

(87) PCT Pub. No.: WO00/26425

PCT Pub. Date: May 11, 2000

(30) Foreign Application Priority Data

Oct. 30, 1998 (JP) ..... 10-310108

(51) Int. Cl.[7] ..... C22C 16/00
(52) U.S. Cl. ..... 148/403; 148/421; 420/423
(58) Field of Search ..... 148/403, 421; 420/423

(56) References Cited

U.S. PATENT DOCUMENTS

| | | | | |
|---|---|---|---|---|
| 5,032,196 A | | 7/1991 | Masumoto et al. | 148/403 |
| 6,010,580 A | * | 1/2000 | Dandliker et al. | 148/403 |

FOREIGN PATENT DOCUMENTS

| | | |
|---|---|---|
| JP | 7-122120 | 12/1995 |
| JP | 8-74010 | 3/1996 |
| JP | 2000-24771 | 1/2000 |
| JP | 2000-26943 | 1/2000 |
| JP | 2000-26944 | 1/2000 |

OTHER PUBLICATIONS

Patent Abstract of Japan, Pub. No. JP–07–062502, Mar. 7, 1995—See PCT search rpt.

Patent Abstract of Japan, Pub. No.JP–07–188877, Jul. 25, 1995—See PCT search rpt.

Patent Abstract of Japan, Pub. No.JP–08–199318, Aug. 6, 1996—See PCT search rpt.

Patent Abstract of Japan, Pub. No.JP–10–186176, Jul. 14, 1998—See PCT search rpt.

Patent Abstract of Japan, Pub. No.JP–08–074010, Mar. 19, 1996.

Patent Abstract of EP0433670, Jun. 26, 1991.

Nikkan Kogyo Shinbun, Nov. 12, 1992 (see spec. p. 2).

Tao Zhang et al., Material Transaction, JIM, vol. 32, No. 11 (1991), pp. 1005 to 1010, "Amorphous Zr–A1–TM (TM=Co, Ni, Cu) Alloys with Significant Supercooled Liquid Region of Over 100 K".

* cited by examiner

*Primary Examiner*—George Wyszomierski
*Assistant Examiner*—Janelle Combs Morillo
(74) *Attorney, Agent, or Firm*—Armstrong, Westerman & Hattori, LLP

(57) ABSTRACT

An amorphous Zr alloy has a composition expressed as $Zr—Al_a—Ni_b—Cu_c—M_d$. M is one or more elements selected from Ti, Nb and Pd. The a, b, c, and d are amounts in atomic %, and satisfy the following formulas. $5 \leqq a \leqq 0$; $30 \leqq b+c \leqq 50$; $b/c \leqq 1/3$; and $0<d \leqq 7$. The remainder are Zr and inevitable impurities. The alloy contains a non-crystalline phase of 90% or higher by volume. Also, the amorphous alloy indicates an excellent glass-forming ability with a supercooled liquid range over 100° C. (indicated by a difference between the crystallization temperature and the glass transition temperature) and which has a thickness of 1 mm or thicker. Further, it has excellent strength and toughness indicated by the following mechanical characteristics: tensile strength of 1800 MPa or higher; flexural strength of 2500 MPa or higher; Charpy impact value of 100 $kJ/m^2$ or higher; and fracture toughness value of 50 $MPa*m^{1/2}$ or higher.

2 Claims, No Drawings

HIGH-STRENGTH HIGH-TOUGHNESS AMORPHOUS ZIRCONIUM ALLOY

FIELD OF THE INVENTION

The present invention relates to amorphous Zr alloys which have a high glass-forming ability and excellent strength and toughness.

RELATED ART

Amorphous metal materials having various forms, such as thin ribbons, filaments, particles and the like, can be obtained by rapidly cooling molten alloys. A thin-ribbon-shaped amorphous alloy is easily manufactured by means of a single roll method, a twin-roller method, an in-rotating water melt spinning method and the like, in which a large cooling speed can be obtained. Conventionally, various amorphous alloys have been provided using alloys of Fe, Ni, Co, Pd, Cu, Zr or Ti; those amorphous alloys show properties unique to amorphous alloys such as high corrosion resistance, high strength, and the like. Especially, an amorphous Zr alloy is expected to be applied to the fields of structural materials, medical materials and chemical materials as a new kind of amorphous alloy having an outstanding high glass-forming ability compared to other amorphous alloys.

However, shapes of the amorphous alloys manufactured by means of previously mentioned methods are limited to thin ribbons or thin wires; it is difficult to process the amorphous alloys of those shapes into a form of final products. Therefore, the uses of such amorphous alloys are limited in industry.

On the other hand, it is known that when amorphous alloys are heated, some of alloys On the other hand, it is known that when amorphous alloys are heated, some of alloys undergo transition to a phase of supercooled liquid before crystallization and indicate a decline in viscosity. For example, when heated at a speed of 40° C. per minute, an amorphous Zr alloy is observed to remain in the supercooled liquid phase for a range of temperature of the maximum of 120° C. before crystallization starts (see Mater. Trans., JIM, Vol. 32, (1991), 1005).

In the supercooled liquid phase, the low viscosity of the amorphous alloy allows one to form it into a given shape by closed squeeze casting process and the like; for example, gears can be formed of an amorphous alloy (see Nikkan Kogyo Shinbun, Nov. 12, 1992). Hence, amorphous alloys having a wide range of the supercooled liquid phase can be said to provide excellent workability. Among such amorphous alloys having a wide range of supercooled liquid phase, an amorphous Zr—Al—Ni—Cu alloy has a range of temperature of 100° C. as the supercooled liquid phase, therefore, is considered to be an amorphous alloy with excellent applicability, such as high corrosion resistance (see Japanese Examined Patent Application Publication H07-122120).

The glass-forming ability and a method for manufacturing of those amorphous alloys have been further improved. As a result, Japanese Laid-Open Patent Application Publication H08-74010 discloses development of an amorphous Zr alloy having a 100° C. range for the supercooled liquid phase and a thickness exceeding 5 mm. Also, various manufacturing methods to improve mechanical characteristics of the amorphous alloys have been tried (Japanese Laid-Open Patent Application Publications: 2000-24771, 2000-26943, 2000-26944); however, these amorphous Zr alloys do not provide sufficient mechanical characteristics as structural materials.

DETAILS OF THE INVENTION

Problems to be Solved

The amorphous Zr alloy described previously has a high glass-forming ability and relatively good strength characteristics due to the range of the supercooled liquid phase above 100° C. Nonetheless, attempts to improve its mechanical characteristics have been made only in the manufacturing method; attempts to improve the composition of alloys has not been made.

Solution of the Problems

Intending to provide an amorphous Zr alloy material having improved strength and toughness without impairing a temperature range for the supercooled liquid phase and a size enabling application to industrial use, inventors of the present invention studied the above issues. They discovered the an amorphous Zr alloy having high strength and toughness as well as excellent glass-forming ability can be obtained by melting an alloy in which a given amount of M element (one or two or more elements selected from a group consisting of Ti, Nb and Pd) is added to a Zr—Al—Ni—Cu—M alloy of a given composition, followed by rapid cooling for solidification.

In other words, the present invention intends to provide an amorphous Zr alloy which contains non-crystalline phase of 90% or higher by volume wherein the alloy has a composition expressed as $Zr—Al_a—Ni_b—Cu_c$13 $M_d$ (in this expression terms are defined as follows:

M: one or two or more elements selected from a group consisting of Ti, Nb and Pd;

a, b, c, and d: atomic % wherein:

$5 \leqq a \leqq 10$;

$30 \leqq b+c \leqq 50$;

$b/c \leqq 1/3$;

$0 < d \leqq 7$;

remainder: Zr and inevitable impurities).

Further, a "range of the supercooled liquid phase" is defined as a difference between a glass transition temperature, obtained by differential scanning thermogravimetry at a speed of heating of 40° C. per minute, and a crystallization temperature. The "range of the supercooled liquid phase" indicates resistance to crystallization, that is, stability of glass-forming ability. The alloy of the present invention has a range of the supercooled liquid phase over 100° C.

PREFERRED EMBODIMENTS OF THE PRESENT INVENTION

The following describes the most preferable embodiments of the present invention.

In an amorphous Zr alloy of the present invention, Ni and Cu are main elements forming the non-crystalline phase; a sum of the amounts of Ni and Cu contained is more than 30 atomic % and less than 50 atomic %. When the sum is less than 30 atomic % or more than 50 atomic %, the single roll method with a high cooling speed can provide the non-crystalline phase while the casting method with a low cooling speed cannot. Further, a ratio of the amount of Ni to the amount of Cu contained, i.e., b/c ratio, is defined to be less than 1/3. This ratio provides dense random packing of the atomic structure of the non-crystalline phase such that the glass-forming ability is maximized.

Also, Al is an element to drastically increase the glass-forming ability of an amorphous Zr alloy of the present invention. The amount of Al contained is more than 5 atomic % and less than 10 atomic %. When the amount contained is less than 5 atomic % or more than 10 atomic %, the glass-forming ability decreases.

M is one or two or more elements selected from a group consisting of Ti, Nb and Pd; additionally, it accelerates the dense random packing of the atomic structure while effectively strengthening the bond strength between atoms. As a result, higher strength and toughness are given to an amorphous Zr alloy having the high glass-forming ability. The amount of M contained is more than 0 atomic % and less than 7 atomic %; more preferably, the amount of Ti and Nb is less than 4 atomic % while Pd is less than 7 atomic %. When the amount of each element contained exceeds the defined atomic %, the bond strength between atoms becomes too strong such that a compound phase with Zr or Al will be formed. The compound phase causes structural discontinuity in the interface with the noncrystalline phase such that the structure is weakened; therefore, desired strength or toughness cannot be obtained.

The amorphous Zr alloy of the present invention can be cooled for solidification by various methods, such as a single roll method, a twin-roller method, an in-rotating water melt spinning method, and an atomizing method to provide various forms, such as thin ribbons, filaments, and particles. Also, the alloy of the present invention has a significantly improved glass-forming ability; therefore, it can be formed into a rod or a plate of a given shape by injecting the molten alloy into a mold. For example, using a known metal mold casting process, a bulk of the alloy can be obtained by injecting casting of the melt into metal mold, which is melted in a quartz tube in an Ar atmosphere, the injecting pressure was fixed to be 0.5 kg/cm$^2$. Furthermore, the amorphous Zr alloy of the present invention has an optimized alloy composition, compared to a conventional amorphous Zr alloy; hence, an excellent glass-forming ability and high strength and toughness can be obtained.

Examples 1 through 14, Comparisons 1 through 8

The following describes examples of the present invention.

Rod-shaped samples with a diameter of 5 mm and a length of 50 mm were prepared using materials having alloy compositions shown in Table 1 by a metal mold casting method. Then, glass transition temperatures (Tg) and crystallization starting temperatures (Tx) were measured using a differential scanning calorimeter (DSC); based on the measurements, a range of the supercooled liquid phase (Tx–Tg) was calculated. A ratio of a non-crystalline phase contained in a rod-shaped sample by volume (vf) was evaluated by comparing the amount of heat generation when the rod-shaped sample crystallized against the amount of heat generation when a completely non-crystallized single rolled sheet crystallized using DSC. In addition, each rod-shaped sample was tested by means of a tensile test, a three-point bending test and the Charpy impact test to measure tension fracture strength (σf), flexural strength (σB.f), i.e., "bending resistance strength", Charpy impact value (E) and fracture toughness (KIc).

TABLE 1

| | | Tx-Tg (K) | Vf (%) | σf (MPa) | σB.f (MPa) | E (kJ/m$^2$) | Klc (MPa*m$^{1/2}$) |
|---|---|---|---|---|---|---|---|
| Example 1 | $Zr_{63}Al_5Ni_5Cu_{25}Ti_2$ | 104 | 98 | 1930 | 2840 | 125 | 54 |
| Example 2 | $Zr_{48.5}Al_{7.5}Ni_{10}Cu_{30}Ti_4$ | 110 | 95 | 2020 | 3010 | 136 | 63 |
| Example 3 | $Zr_{41}Al_5Ni_5Cu_{45}Ti_4$ | 108 | 94 | 1980 | 2990 | 131 | 60 |
| Example 4 | $Zr_{55.5}Al_{7.5}Ni_5Cu_{30}Nb_2$ | 112 | 97 | 1890 | 2700 | 128 | 57 |
| Example 5 | $Zr_{46}Al_{10}Ni_{10}Cu_{30}Nb_4$ | 125 | 100 | 2050 | 3100 | 141 | 66 |
| Example 6 | $Zr_{46}Al_5Ni_{10}Cu_{35}Nb_4$ | 101 | 94 | 1970 | 2920 | 128 | 59 |
| Example 7 | $Zr_{55.5}Al_{7.5}Ni_5Cu_{30}Pd_2$ | 109 | 100 | 2100 | 3350 | 150 | 69 |
| Example 8 | $Zr_{56}Al_{10}Ni_5Cu_{25}Pd_4$ | 121 | 100 | 2080 | 3300 | 144 | 68 |
| Example 9 | $Zr_{44}Al_{10}Ni_{10}Cu_{30}Pd_6$ | 108 | 100 | 2210 | 3510 | 154 | 71 |
| Example 10 | $Zr_{48}Al_5Ni_5Cu_{35}Pd_7$ | 106 | 100 | 2130 | 3200 | 139 | 65 |
| Example 11 | $Zr_{51}Al_5Ni_{10}Cu_{30}Ti_2Pd_2$ | 115 | 100 | 2000 | 2990 | 123 | 54 |
| Example 12 | $Zr_{51}Al_5Ni_5Cu_{35}Ti_2Nb_2$ | 118 | 98 | 2080 | 3150 | 137 | 63 |
| Example 13 | $Zr_{43.5}Al_{7.5}Ni_{10}Cu_{35}Nb_2Pd_2$ | 113 | 96 | 2150 | 3220 | 139 | 63 |
| Example 14 | $Zr_{60}Al_5Ni_5Cu_{25}Ti_2Nb_1Pd_2$ | 112 | 100 | 1890 | 2840 | 120 | 51 |
| Comparison 1 | $Zr_{55}Al_{10}Ni_5Cu_{30}$ | 104 | 100 | 1620 | 1710 | 71 | 44 |
| Comparison 2 | $Zr_{42}Al_5Ni_5Cu_{40}Ti_8$ | 88 | 70 | 1400 | 1210 | 40 | 22 |
| Comparison 3 | $Zr_{42}Al_5Ni_5Cu_{40}Nb_8$ | 69 | 51 | 1260 | 1170 | 35 | 20 |
| Comparison 4 | $Zr_{42}Al_5Ni_5Cu_{40}Pd_8$ | 98 | 78 | 1650 | 1680 | 73 | 45 |
| Comparison 5 | $Zr_{54}Al_2Ni_{10}Cu_{30}Pd_4$ | 70 | 55 | 1180 | 990 | 32 | 18 |
| Comparison 6 | $Zr_{43.5}Al_{12.5}Ni_{10}Cu_{30}Ti_4$ | 43 | 30 | 670 | 690 | 19 | 11 |
| Comparison 7 | $Zr_{41}Al_{10}Ni_{13}Cu_{30}Pd_6$ | 118 | 100 | 1720 | 1750 | 88 | 48 |
| Comparison 8 | $Zr_{42}Al_5Ni_{20}Cu_{30}Ti_3$ | 65 | 48 | 980 | 1050 | 36 | 21 |

As is clearly shown in Table 1, die-cast amorphous alloy materials of Examples 1 through 14 show: a range of the supercooled liquid phase of over 100° C.; a ratio of the non-crystalline phase by volume of 90% or higher, providing a large glass-forming ability; tensile strength of 1800 MPa or higher; flexural strength of 2500 MPa or higher; Charpy impact values of 100 kJ/m$^2$ or higher; fracture toughness values of 50 MPa*m$^{1/2}$ or higher, providing excellent strength and toughness.

On the other hand, the alloy of Comparison 1 shows an excellent glass-forming ability in which a cast material with a diameter of 5 mm is completely non-crystallized; however, a lack of the M element causes deteriorated mechanical characteristics. Also, the cast materials of Comparisons 2, 3 and 4 contain the M element for the amount exceeding the predetermined 7%; as a result, a range of the supercooled liquid phase and a ratio of the non-crystalline phase by volume are less than 100° C. and 90%, respectively, indicating no improvement in mechanical characteristics. Comparisons 5 and 6 do not satisfy the predetermined amount of Al contained, more than 5 % or less than 10%; hence, the supercooled liquid range and the glass-forming ability are 100° C. and 90%, respectively, and the mechanical characteristics are extremely poor. Further, Comparisons 7 and 8 show no improvement in the mechanical characteristics since the ratio of Ni to Cu, b/c, exceeds the value predetermined in the present invention, 1/3.

Application of the Present Invention

As described above, an amorphous Zr alloy of the present invention indicates a supercooled liquid range over 100° C., as well as excellent strength and toughness shown by: tensile strength of 1800 MPa or higher; flexural strength of 2500 MPa or higher; Charpy impact values of 100 $kJ/M^2$ or higher; fracture toughness values of 50 $MPa*m^{1/2}$ or higher. Therefore, the present invention is able to provide a useful amorphous Zr alloy which has a high glass-forming ability and excellent strength and toughness.

We claim:

1. An amorphous Zr alloy which has a composition expressed as $Zr—Al_a—Ni_b—Cu_c—M_d$, wherein terms are defined as follows:

M: one or more elements selected from a group consisting of Ti, Nb and Pd; and a, b, c, and d: values in atomic % satisfying the following relation, $5 \leqq a \leqq 10$, $30 \leqq b+c \leqq 50$, $b/c \leqq 1/3$, $0 < d \leqq 7$, and Zr and inevitable impurities being remainder, wherein said amorphous Zr alloy contains a non-crystalline phase of 90% or higher by volume.

2. An amorphous Zr alloy according to claim 1 which indicates an excellent glass-forming ability with a supercooled liquid range over 100° C., indicated by a difference between the crystallization temperature and the glass transition temperature, and which has a thickness of 1 mm or thicker.

* * * * *